US007730641B2

(12) United States Patent
Ruuska

(10) Patent No.: US 7,730,641 B2
(45) Date of Patent: Jun. 8, 2010

(54) BLADE ELEMENT MOUNTING IN A SNOW PLOUGH

(75) Inventor: Mauno Ruuska, Roismala (FI)

(73) Assignee: Hagie Manufacturing Company, Clarion, IA (US)

( * ) Notice: Subject to any disclaimer, the term of this patent is extended or adjusted under 35 U.S.C. 154(b) by 309 days.

(21) Appl. No.: 11/576,977

(22) PCT Filed: Oct. 11, 2005

(86) PCT No.: PCT/FI2005/000434

§ 371 (c)(1),
(2), (4) Date: Jan. 3, 2008

(87) PCT Pub. No.: WO2006/040396

PCT Pub. Date: Apr. 20, 2006

(65) Prior Publication Data

US 2008/0250675 A1 Oct. 16, 2008

(30) Foreign Application Priority Data

Oct. 11, 2004 (FI) ..... 20041314

(51) Int. Cl.
*E01H 5/04* (2006.01)

(52) U.S. Cl. ..... 37/232; 37/266; 37/268; 172/816

(58) Field of Classification Search ..... 37/232, 37/233, 266, 268; 172/811, 816
See application file for complete search history.

(56) References Cited

U.S. PATENT DOCUMENTS 3,014,289 A * 12/1961 Torrey ..... 37/233
3,199,234 A * 8/1965 Gottfried ..... 37/233
3,466,766 A 9/1969 Kahlbacher
3,712,383 A * 1/1973 Renahan ..... 172/264
3,772,803 A * 11/1973 Cote ..... 37/233
3,793,752 A * 2/1974 Snyder ..... 37/234
3,808,714 A * 5/1974 Reissinger et al. ..... 37/233
3,845,577 A * 11/1974 Naymik ..... 37/231
4,176,477 A * 12/1979 Farden ..... 37/104
4,254,564 A * 3/1981 Rath ..... 37/236
4,259,794 A * 4/1981 Rath ..... 37/233
4,307,523 A * 12/1981 Reissinger et al. ..... 37/233

(Continued)

FOREIGN PATENT DOCUMENTS

DE 881200 6/1953

(Continued)

*Primary Examiner*—Thomas B Will
*Assistant Examiner*—Jamie L McGowan
(74) *Attorney, Agent, or Firm*—Stites & Harbison PLLC; Douglas E. Jackson

(57) ABSTRACT

Flexible suspension of colter element (1) of a snowplough furnished with a body (5), a blade (3) as its extension, colter element (1) that gets in contact with the surface to be ploughed, where for the colter element (1) a tilt suited for the purpose is arranged, a.o. a cutting angle. Colter element (1) is fitted to dodge an obstacle in its cutting angle by backing up, whereby the fixing arrangement of colter element (1) has an open space formed for moving plate (13) fitted as extension of the colter element, in which space said moving plate is arranged to glide, and the arrangement includes a spring organ (9) the spring impact of which is arranged to hinder the colter element from backing up.

4 Claims, 2 Drawing Sheets

U.S. PATENT DOCUMENTS

| | | | | | |
|---|---|---|---|---|---|
| 4,635,387 | A | * | 1/1987 | Haring | 37/232 |
| 5,437,113 | A | * | 8/1995 | Jones | 37/233 |
| 5,697,172 | A | * | 12/1997 | Verseef | 37/232 |
| 6,751,894 | B2 | * | 6/2004 | Verseef | 37/266 |
| 7,467,485 | B2 | * | 12/2008 | Lachance et al. | 37/232 |
| 7,543,401 | B2 | * | 6/2009 | Hughes | 37/232 |
| 7,596,892 | B2 | * | 10/2009 | Ruuska | 37/266 |
| 2006/0000122 | A1 | * | 1/2006 | Micozzi | 37/232 |
| 2006/0042128 | A1 | * | 3/2006 | Schultz et al. | 37/232 |

FOREIGN PATENT DOCUMENTS

| | | | | |
|---|---|---|---|---|
| DE | 3205973 | A1 | * | 9/1983 |
| DE | 3205974 | A1 | * | 9/1983 |
| DE | 3319223 | A | * | 7/1984 |
| GB | 784049 | | | 10/1957 |
| GB | 1060335 | | | 3/1967 |

* cited by examiner

BLADE ELEMENT MOUNTING IN A SNOW PLOUGH

FIELD OF THE INVENTION

The invention relates to a flexible mounting or suspension of the colter of a snowplough that gets in contact with the surface to be ploughed, the colter including a blade as its extension. The suspension for the colter is at a tilt or a cutting angle suited for the purpose. When the snowplough is ploughing uneven ground, the colter must adjust to the roughness of ground. The flexible material of the colter is not enough alone, so the suspension of the colter must also be flexible. The need of flexibility grows with the width of the snowplough and the demands of the ploughing cleanliness.

BACKGROUND OF THE INVENTION

In using flexible colters of polyurethane or rubber, the load of the colter against the surface to be ploughed must be small, but the colter must stay in same colter angle during flexing movement. The smallness of vertical force pressing the colter is important in order to minimize wear and tear of the colter and to lengthen the life of the colter. A correct position keeps the cutting of colter edge sharp without rounding the lower surface. Rounding of colter lower surface makes the cutting edge of the coulter rise from the ground, so that snow getting under the colter lifts the colter to glide on the snow layer. The result is weakened ploughing quality.

Backing of the colter in its movement direction against a spring is known for instance from publications DE 881200, GB 1060335, GB 784049. In these publications, the colter is a plate of large size, which must always be replaced as a whole when sufficiently worn out. For the colter plate, a quite long backward directed steering box portion is arranged, which keeps the colter in the desired direction.

In using an additional colter, this colter must have same possibilities to follow the roughness of surface as the first colter.

Previously known is a suspension of a colter, where the whole plough, that is the blade and colter, is divided into transverse elements which are flexing vertically on levers or on flexible attachments. The disadvantages of this solution are the relatively heavy elements, which cause the colters to have a wearing load and hard strokes on obstacles during ploughing, because of the mass of elements. The moving of the elements gives cause to discontinuity on the blade surface and restricts the blade forming. The circle curve is almost the only possible cross-section of the blade, if the motion is dimensioned to follow the curve. The direction of the evasive movement by means of lever mechanisms is in a relatively great angle in regard to the driving motion direction and thus disadvantageous.

Previously known is also a solution where the colter is divided into separately suspended elements, which suspended elements function simply as steered by springs or separate elements, as in GB 784049. There are wearing parts in the control mechanisms. Colters resting merely on springs have too great colter forces and often insufficient control, which lead to rapid wearing and blade bottom rounding. Known is also a solution where the colter is suspended on springs of elastic rubber or of plastic.

The disadvantage of said solutions is weak control, whereby the colter wears out into a wrong form. Another disadvantage appears in speedy ploughing, and the attendant risk connected to overheating of spring material and to loss of spring material firmness due to inside frictions.

For suspension of an additional colter a further solution is known, where the additional colter is furnished with its own mechanisms both for the vertical and evasive backward motion of the colter. This is an expensive solution containing many parts.

SUMMARY OF THE INVENTION

By means of the solution according to this invention, most of the above noted disturbances of the colter suspension are avoided. The suspension according to this invention is characterized in that to a spring organ a detachable colter is attached, as an extension and to which a moving plate attached to the colter element is fitted. This moving plate is located in an open space between the attached colter and a covering plate located at a distance from the colter, whereby the moving plate is fitted to glide in the open space.

The advantage of the suspension according to this invention is that each colter, and that to it a possibly connected additional colter, is built as a flexible unit, which due to its flexible attachment gets in contact against the surface. The additional colter can be fixed to the attachments of the colter, whereby the additional colter follows the colter motions. This approximate control is sufficient when both colters are flexible. The additional colter has a stabilizing extra impact on the actual colter. At the same time, the sequential colters give in the manner of the boggie each other the control to keep the colters in a desired working direction.

BRIEF DESCRIPTION OF THE DRAWINGS

In the following the invention is disclosed with reference to the enclosed drawings, where.

In the following the invention is disclosed with reference to the enclosed drawing, where.

DETAILED DESCRIPTION OF THE INVENTION

Figure 1:
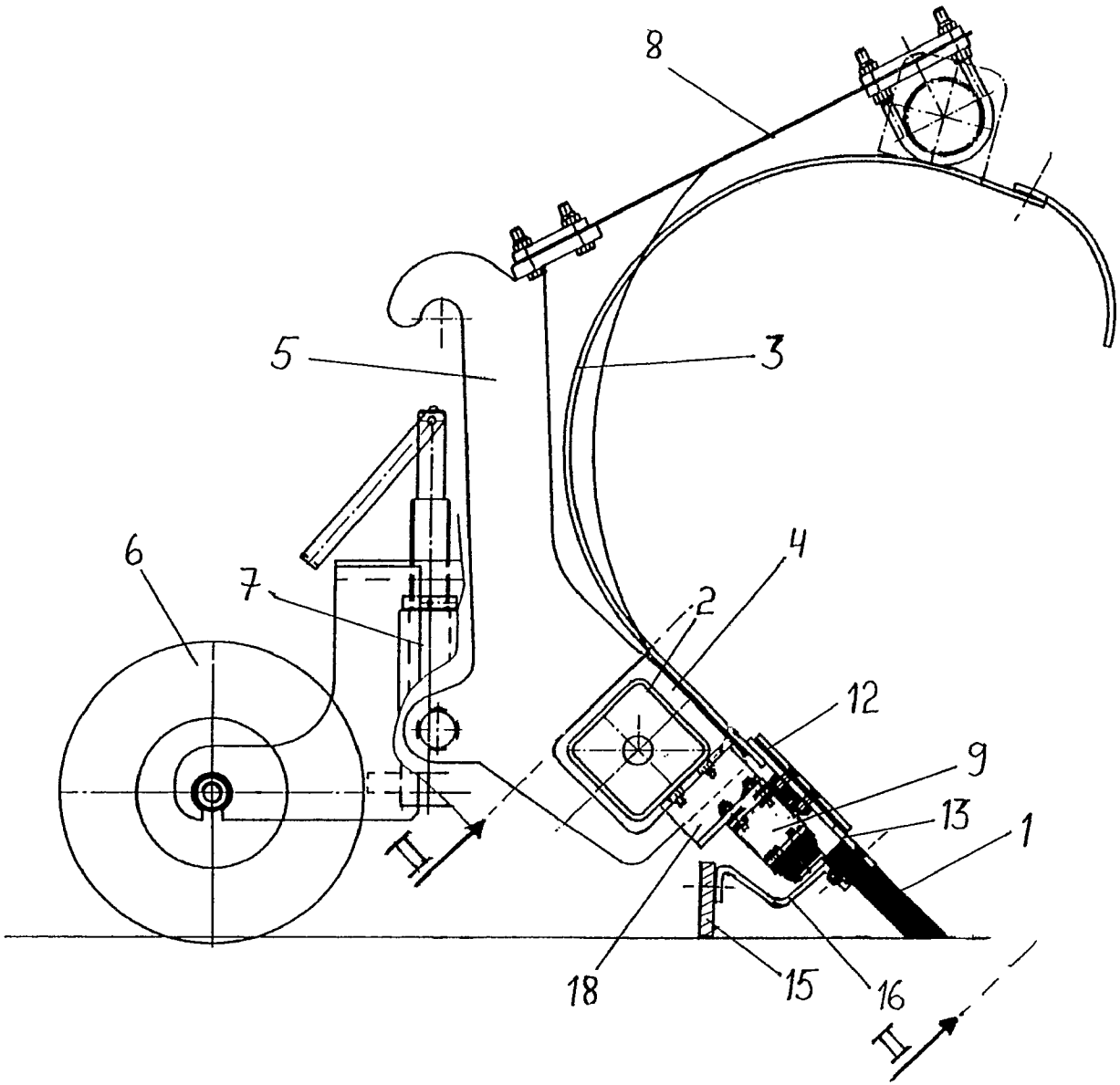
FIG. 1 shows a snow plough viewed from the end.

FIG. 1 shows a snowplough furnished with a body 5, a height adjusting device 7 for a support wheel 6 and a colter 1 including blade 3 as its extension. Blade 3 is made of flexible material and supported by means of holders 8. There is in the body 5 lower part a horizontal beam 2 in which the colter 1 and lower edge 4 of blade 3 are fixed.

As extension of colter 1 there is a moving plate 13, which can move between the surface of fixed blade 3 and a cover plate 12. Colter 1 is attached to a moving plate 13 and to the flexing lower end of a spring organ 9. The upper end of spring organ 9 at fixing points 11 is attached to horizontal beam 2 by means of a distance piece 18. Spring organ 9 is a leaf spring bent into U-shape. Cover plate 12 is attached immovable in regard to fixed blade 3. Moving plate 13, cover plate 12, and fixed blade 3 are all at least partly overlapping each other.

The U-shape of spring organ 9 tends to open; and when functioning as a colter backing, the U-shape tends to narrow, in other words fixing points 10 and 11 (FIG. 2) come closer to each other.

FIG. 1 shows also an additional colter 15, which is by means of a shaft 16, bent of spring steel, attached to colter 1. Thus the additional colter 15 flexes like colter 1 in the flexing direction of colter 1.

Figure 2:
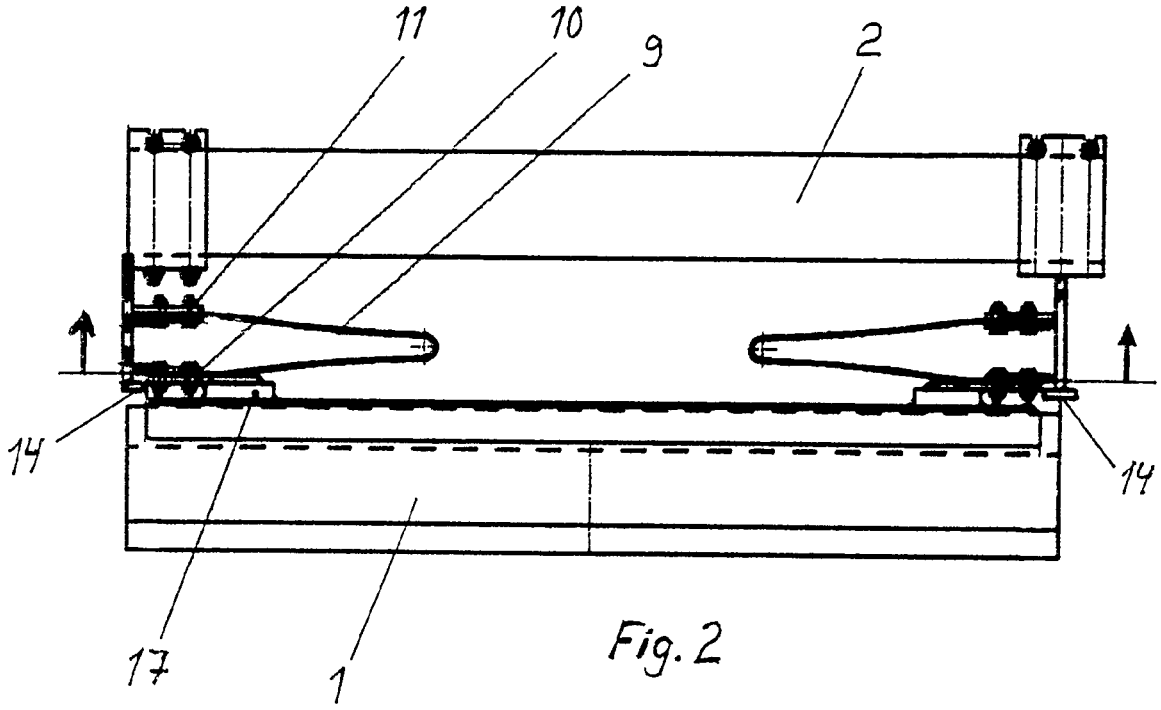
FIG. 2 shows the sectional view II-II of the construction in FIG. 1.

FIG. 2 shows a portion of the plough lower part from behind. U-shaped leaf springs of spring organ 9 tend to open and press colter 1 down. Stoppers 14 are connected to the end, which allow colter 1 to get down only to a certain limit, even if spring organ 9 would tend to press the colter more downward. By means of this stopper solution for the colter, initial stress is achieved to prevent backing. Thanks to the solution, the springback factor of the spring organ 9 remains almost unchangeable throughout a possible backing distance arranged for the colter. Between the spring organ 9 lower fastening point 10 and colter 1 there can also be a damping piece 17.

The colter 1 is attached at least between the ends of two leaf springs of spring organ 9 bent into U-shape and running in a colter direction, while the other spring ends are attached to the plough body. U-shaped leaf springs function as rough straight-through mechanisms. The holding power in the direction of motion caused by bumpy surface is smallest, and at its greatest in the direction that keeps the colter in a desired position. The arrangement presses the colter with a relatively small load against the surface being ploughed, and at the same time keeps the colter steady in the cutting position.

The advantage of prestressed spring suspension is the possibility of relatively small growth of the springback factor, while the spring route gets longer and at the same time for the colter an operating area is achieved at once after the limitation without any additional routes of motion, which would demand additional height for plough lifting, for instance in a transporting position.

Advantageously the plough is formed of several colter elements side by side, which have separated flexing arrangements. Then only relatively small masses have to back up on hitting an obstacle. Even the ploughing result weakens only at the backed up colter. Blade portion 3 can be continuous along the whole plough width.

The invention claimed is:

1. A snowplough comprising:

a body;

a longitudinal colter;

a flexible suspension which suspends the colter to the body such that the colter is in contact with the surface to be ploughed and is set into a tilted cutting angle;

a fixed blade which is an upwards extension of the colter;

a spring organ which is detachably attached to the colter and which backs up the colter to enable the colter to dodge an obstacle by backing up against the spring organ;

a moving plate attached to and extending the colter toward the blade;

a cover plate in front of the fixed blade;

a mounting space formed between the fixed blade and the cover plate whereby the moving plate is fitted to glide in the mounting space back up towards the fixed blade and then back down; and wherein the spring organ includes at least two U-shaped leaf springs, each U-shaped leaf spring extending in a longitudinal direction along the colter and having a U-shape in a cross section parallel to the cutting angle, one leg end of each U-shaped leaf spring being attached to the body and the other leg end being attached to the colter such that the two U-shaped leaf springs together work essentially as straight-through mechanisms to back up the colter.

2. A snowplough according to claim 1, wherein the cover plate is immobile relative to the fixed blade and at least partly overlapping with the fixed blade.

3. A snowplough according to claim 1, wherein the moving plate is at least partly overlapping with the fixed blade.

4. A snowplough according to claim 1, further including an additional colter following behind the first-mentioned colter and attached to the colter by a fixing device, and wherein the flexible suspension suspends both said additional and first-mentioned colters in contact with the surface at the same time.

* * * * *